US010142719B2

(12) United States Patent
Yoshino

(10) Patent No.: US 10,142,719 B2
(45) Date of Patent: Nov. 27, 2018

(54) MICROPHONE

(71) Applicant: Audio-Technica Corporation, Tokyo (JP)

(72) Inventor: Satoshi Yoshino, Tokyo (JP)

(73) Assignee: Audio-Technica Corporation, Tokyo (JP)

( * ) Notice: Subject to any disclaimer, the term of this patent is extended or adjusted under 35 U.S.C. 154(b) by 0 days.

(21) Appl. No.: 15/846,705

(22) Filed: Dec. 19, 2017

(65) Prior Publication Data

US 2018/0192175 A1 Jul. 5, 2018

(30) Foreign Application Priority Data

Jan. 5, 2017 (JP) ..... 2017-000390

(51) Int. Cl.

| | |
|---|---|
| ***H04R 1/04*** | (2006.01) |
| ***H04R 1/08*** | (2006.01) |
| ***F21V 23/04*** | (2006.01) |
| ***F21V 23/06*** | (2006.01) |
| ***F21V 33/00*** | (2006.01) |

(52) U.S. Cl.

CPC ..... *H04R 1/04* (2013.01); *F21V 23/0435* (2013.01); *F21V 23/06* (2013.01); *F21V 33/0056* (2013.01); *H04R 1/08* (2013.01)

(58) Field of Classification Search

CPC ..... H04R 1/04; H04R 1/08; F21V 23/0435; F21V 23/06; F21V 33/0056

USPC ..... 381/111–117

See application file for complete search history.

(56) References Cited

U.S. PATENT DOCUMENTS

| | | | | |
|---|---|---|---|---|
| 4,567,608 A * | 1/1986 | Watson | H04R 1/08 | 381/111 |
| 2002/0186855 A1* | 12/2002 | Akino | H04R 3/00 | 381/111 |
| 2006/0083392 A1* | 4/2006 | Akino | H04R 19/04 | 381/122 |
| 2006/0146688 A1* | 7/2006 | Akino | H04R 1/04 | 370/200 |
| 2018/0007459 A1* | 1/2018 | Yoshino | H04R 3/00 | |

FOREIGN PATENT DOCUMENTS

JP 2016-163054 A 9/2016

* cited by examiner

*Primary Examiner* — David Ton
(74) *Attorney, Agent, or Firm* — W&C IP

(57) ABSTRACT

A microphone includes a head case and an arm that supports the head case. The head case includes a microphone unit and a light emitter. A proximal end portion of the arm includes a light emitter circuit that turns on the light emitter on the basis of potential information of a specific terminal. One end of the light emitter is connected to the light emitter circuit through a wire that passes through an inside of the arm. The other end of the light emitter is connected to the microphone unit in the head case. The light emitter circuit includes a switching element that switches on and off of light emitter. The specific terminal is connected to a control signal input side of the switching element.

9 Claims, 4 Drawing Sheets

MICROPHONE

BACKGROUND

Technical Field

The present invention relates to a microphone.

Related Art

Gooseneck microphones are known as conference microphones respectively installed on a speech stand and conference attendee desks of a conference room. The gooseneck microphone includes an arm made of a flexible pipe that allows easy adjustment of the angle and the height. A head case in which a microphone unit is accommodated is arranged at a distal end of the arm. A connector is provided at the other end of the arm, that is, at a proximal end portion of the arm, and can be connected with a microphone connecting device that receives an audio signal from the microphone.

For example, JP 2016-163054 A discloses a microphone connecting device configured to be connectable with a microphone having a light emitter mounted, the light emitter causing a conference participant and a conference assistant such as a mixer operator who operates signals from a plurality of microphones to identify a microphone in operation, and configured to detect connection of the microphone including the light emitter and control a lighting circuit of the light emitter.

FIG. 3 illustrates a circuit configuration diagram of a microphone 101 disclosed in JP 2016-163054 A. All of a condenser microphone unit 104, an LED 105 as a light emitter, and a microphone circuit 121 for operating the microphone 101 are accommodated in a microphone unit case 100.

The microphone 101 includes a connector 106. The connector 106 is a three-pin connector including a first pin 161, a second pin 162, and a third pin 163. The connector 106 is connected with a connector 60 of a microphone amplifier unit 11 with a shielded cable. A phantom power supply is supplied to the microphone circuit 121 from the microphone amplifier unit 11 through the second pin 162 and the third pin 163 of the connector 106.

The LED 105 has one end connected to a constant voltage circuit 107 of the microphone circuit 121 operated by the phantom power supply, and the other end connected to the first pin 161 of the connector 106. The first pin 161 is connected in series with a switch 30 controlled by the microphone amplifier unit 11 through the shielded cable and the output connector 60. The first pin 161 is connected to a ground line 199 when the switch 30 is short-circuited. A voltage is supplied to the LED 105 through the constant voltage circuit 107 only when the switch 30 is short-circuited.

The microphone circuit 121 is switched on and off on the side of the microphone amplifier unit 11. The switch 30 is operated in conjunction with on and off of the microphone 101, and is controlled to turn on the LED 105 when the microphone 101 is on, that is, when the microphone 101 is collecting sounds, and turn off the LED 105 when the microphone 101 is off.

Here, consider a microphone having a microphone unit and a light emitter arranged in a head case of a gooseneck microphone, and having a circuit for controlling the microphone and an LED arranged in a proximal end portion of an arm. When using the circuit configuration in FIG. 3 as it is for the above microphone, the circuit configuration diagram becomes the one illustrated in FIG. 4. In FIG. 4, a microphone unit 204, an LED 205, and the like are arranged in a head case 220, and a microphone circuit 221 is arranged in a proximal end portion of the arm, and an element in the head case 220 and the microphone circuit 221 are connected with a wire that passes through an inside of the arm. That is, a wire connected to an anode of an LED 205 and a wire connected to a cathode of the LED 205 are arranged in the arm. In this way, two lines necessary for controlling the LED 205 need to be arranged in the arm, and there is a problem that a wire material in the arm becomes thick.

In view of the foregoing, a technology for reducing the number of wires in the arm in the gooseneck microphone including the light emitter on the head case side is needed.

SUMMARY

An object of the present invention is to reduce the number of wires in an arm in a gooseneck microphone including a light emitter on a head case side.

A microphone according to the present invention is a microphone including a head case and an arm that supports the head case, wherein the head case includes a microphone unit and a light emitter, a proximal end portion of the arm includes a light emitter circuit that turns on the light emitter on the basis of potential information of a specific terminal, one end of the light emitter is connected to the light emitter circuit through a wire that passes through an inside of the arm, the other end of the light emitter is connected to the microphone unit in the head case, and the light emitter circuit includes a switching element that switches on and off of the light emitter and the specific terminal is connected to a control signal input side of the switching element.

According to the present invention, the number of wires in an arm can be reduced in a gooseneck microphone including a light emitter on a head case side.

DETAILED DESCRIPTION

•Microphone•

Hereinafter, embodiments of a microphone according to the present invention will be described with reference to the drawings.

Figure 1:
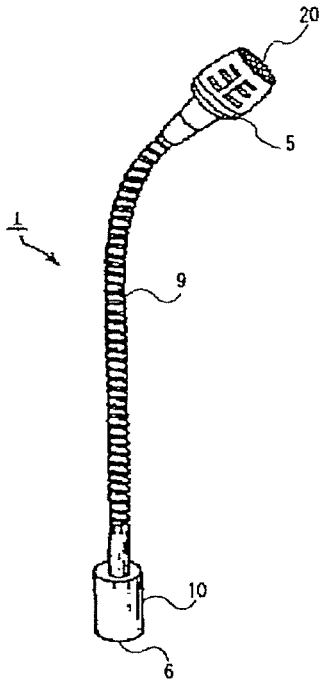
FIG. 1 is a perspective view illustrating an embodiment of a microphone according to the present invention.
Figure 2:
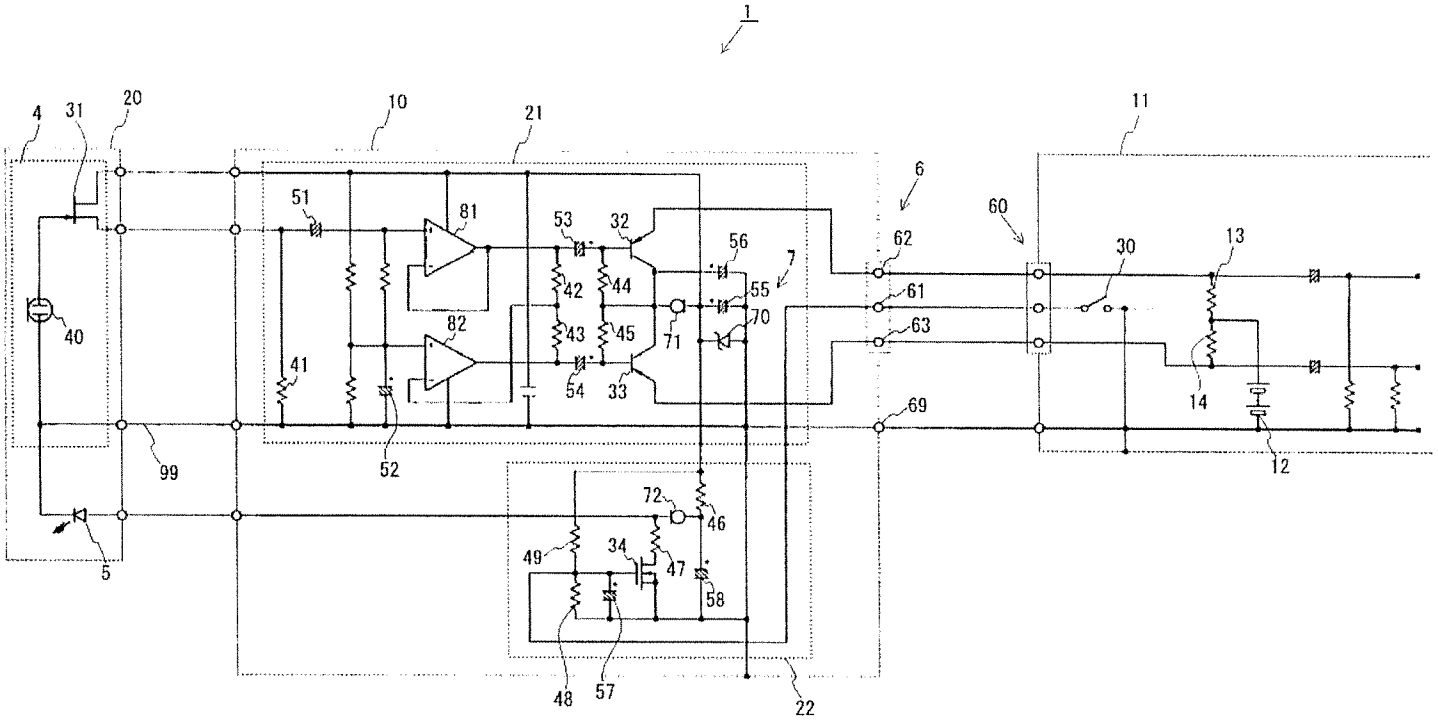
FIG. 2 is a circuit configuration diagram of the microphone.

As illustrated in FIG. 1, a microphone 1 configures a gooseneck microphone. The microphone 1 is provided with an arm 9 made of a flexible pipe that allows easy adjustment of an angle and a height. At a distal end of the arm 9, a head case 20 in which a microphone unit and an LED 5 as a light emitter are accommodated is arranged. Further, at the other end of the arm 9, a proximal end portion 10 of the arm 9, in which a microphone circuit 21 and an LED circuit 22 illustrated in FIG. 2 are accommodated is provided. A three-pin connector 6 is fixed to the proximal end portion 10, the three-pin connector 6 being connectable with a connector 60 of a microphone amplifier unit 11 that receives an audio signal from the microphone 1.

The LED 5 is arranged in such a manner that an emitted light of the LED 5 can be visually recognized from an outside of the head case 20. The LED 5 may be fixed to an outside of the head case 20. Alternatively, the LED 5 may be configured to be fixed to an inside of the head case 20 in such a manner that the light of the LED 5 can be visually recognized from the outside of the head case 20 through a light-transmissive window provided in the head case 20.

•Circuit Configuration Inside Head Case 20•

As illustrated in FIG. 2, a microphone unit 4 and the LED 5 are accommodated in the head case 20. The microphone unit 4 is an electret condenser microphone unit provided with an electret layer on either a diaphragm or a fixed electrode, the diaphragm and the fixed electrode facing each other. The microphone unit 4 includes a microphone element 40 and an FET 31 that functions as an impedance converter. One of the fixed electrode and the diaphragm of the microphone element 40, and a cathode of the LED 5 are connected to a shared ground line 99. The other of the fixed electrode and the diaphragm of the microphone element 40 is connected to a gate of the FET 31 as an impedance converter.

Wires connected to a drain and a source of the FET 31 and the wire connected to the anode of the LED 5 pass through an inside of the arm 9 and are connected to the microphone circuit 21 and elements in the LED circuit 22. A connection line between the microphone unit 4 and the microphone circuit 21 is accommodated in the arm 9. The cathode of the LED 5 is connected to the ground line 99 together with one of the fixed electrode and the diaphragm of the microphone element 40 in the head case 20. That is, in the present embodiment, the number of wires that passes through the inside of the arm 9 is three.

The ground line 99 is conductive with the flexible pipe that covers the outside of the arm 9, and the flexible pipe itself is grounded. The ground line 99 is also conductive with an outer casing of the proximal end portion 10, and prevents noises from entering the circuit and wires from an outside. When the connector 6 of the microphone 1 is coupled with the connector 60 of the microphone amplifier unit 11, both frames are electrically coupled to each other and grounded. In other words, the ground line 99 is conductive with a ground line of the microphone amplifier unit 11 through a frame ground terminal 69 provided in the connector 6.

The cathode of the LED 5 is connected to the ground line 99 shared with the microphone unit 4. The wire connected to the anode of the LED 5 passes through the inside of the arm 9 and is connected to a cathode of a constant current element 72 in the LED circuit 22.

A DC operating voltage is supplied to the drain of the FET 31 from a constant voltage circuit 7 to be described later. Further, the source of the FET 31 is connected to the ground line 99 through a source resistor 41. That is, the FET 31 configures a source follower circuit.

•Circuit Configuration of Microphone Circuit 21•

The microphone circuit 21 that balanced outputs an output signal of the microphone unit 4 to the microphone amplifier unit 11 and the LED circuit 22 that controls an operation of the LED 5 are accommodated in the proximal end portion 10 of the arm 9.

First, the microphone circuit 21 will be described. The microphone 1 is configured such that a second pin 62 of the connector 6 is used as a hot side of a signal and a third pin 63 is used as a cold side of a signal, and the signal is balanced output. The ground line 99 is connected to the frame ground terminal 69.

A coupling capacitor 51 is connected to the source of the FET 31. An impedance-converted signal from the microphone unit 4 is input to a non-inverting input terminal of a first operational amplifier 81 through the coupling capacitor 51. An output terminal of the first operational amplifier 81 is connected to an inverting input terminal of a second operational amplifier 82 through a resistor 42. A non-inverting input terminal of the second operational amplifier 82 is connected to the ground line 99 through a capacitor 52. Further, a feedback resistor 43 is connected between the inverting input terminal and an output terminal of the second operational amplifier 82.

Values of the input resistor 42 and the feedback resistor 43 are equal. That is, the second operational amplifier 82 configures an inverting amplifier with a voltage amplification factor of −1.

An output of the first operational amplifier 81 and an output of the second operational amplifier 82 are generated on the basis of the signal obtained by the microphone unit 4, and are in a relationship of reverse phases to each other, that is, in a balanced output state. Respective balanced output signals are respectively supplied to bases of PNP transistors 32 and 33 through coupling capacitors 53 and 54.

The transistor 32 configures a first emitter follower circuit including a bias resistor 44. An output of the first emitter follower circuit is supplied to the second pin 62 of the connector 6 as a hot-side output of the signal. Further, the transistor 33 configures a second emitter follower circuit including a bias resistor 45. An output of the second emitter follower circuit is supplied to the third pin 63 of the connector 6 as a cold-side output of the signal.

Further, the microphone amplifier unit 11 is provided with a DC power supply 12 for feeding phantom power to the microphone 1. Both ends of the DC power supply 12, when configured as a phantom power supply, are respectively connected to one ends of the resistors 13 and 14 having substantially the same resistance value. The other ends of the resistors 13 and 14 are respectively connected to the second pin 62 and the third pin 63 of the connector 6. Therefore, a DC voltage of the DC power supply 12 is equally divided on the hot side and the cold side and is sent to the microphone side. That is, connection of the connector 6 configures a phantom power feed circuit that balanced outputs, from the microphone 1 side, the audio signal from the microphone 1 to the microphone amplifier unit 11, and applies, from the microphone amplifier unit 11 side, the DC voltage to the microphone 1.

The DC voltage from the phantom power feed circuit is supplied to collectors of the transistors 32 and 33 that configure the first and second emitter follower circuits. A constant current element 71 is connected to emitters of the transistors 32 and 33. A constant voltage element 70 and a capacitor 55 are connected in parallel between the constant current element 71 and the ground line 99. The constant voltage element 70 and the capacitor 55 configure the constant voltage circuit 7, and the constant voltage circuit 7 supplies a drive voltage to the FET 31, the first operational amplifier 81, and the second operational amplifier 82. Further, the constant voltage circuit 7 supplies a drive voltage to a MOS-FET 34 of the LED circuit 22 described below.

•Circuit Configuration of LED Circuit 22•

Next, the LED circuit 22 will be described. The LED circuit 22 includes the constant current element 72 and a MOS-FET 34. The constant current element 72 is an element for supplying a constant current to the LED 5. An anode of the constant current element 72 is connected to the constant voltage circuit 7 through a resistor 46. The cathode of the constant current element 72 is connected to the anode of the LED 5 as described above. Further, the cathode of the constant current element 72 is connected to a drain terminal of the MOS-FET 34 through a resistor 47.

A source terminal of the MOS-FET 34 is connected to the ground line 99. A voltage by the constant voltage circuit 7 is supplied to a gate terminal of the MOS-FET 34 through a gate resistor 49 as a drive voltage. A resistor 48 is connected between the gate and the source of the MOS-FET 34. Resistance values of the resistor 48 and the gate resistor 49 are appropriately determined according to the MOS-FET standard.

Further, the gate terminal of the MOS-FET 34 is connected to a first pin 61 of the connector 6.

As illustrated in FIG. 2, bypass capacitors 56, 57, and 58 may be appropriately connected to active elements such as the MOS-FET 34.

•Configuration of Microphone Amplifier Unit 11•

On the microphone amplifier unit 11 side, the switch 30 is connected in series to a connection line to the first pin 61 of the connector 6. Opening and short circuit of the first pin 61 and the frame ground terminal 69 can be switched by opening and closing of the switch 30. The microphone amplifier unit 11 is wired to conduct the first pin 61 of the connector 6 with the frame ground on the microphone amplifier unit 11 side when the switch 30 is closed.

Note that the microphone circuit 21 is switched on and off on the microphone amplifier unit 11 side. The switch 30 is operated in conjunction with on and off of the microphone 1, and is "closed" when the microphone 1 is on and is "opened" when the microphone 1 is off. Therefore, the switch 30 is controlled in such a manner that the LED 5 is turned on when the microphone 1 is on, that is, when the microphone 1 is collecting sounds, and the LED 5 is turned off when the microphone 1 is off.

Figure 3:
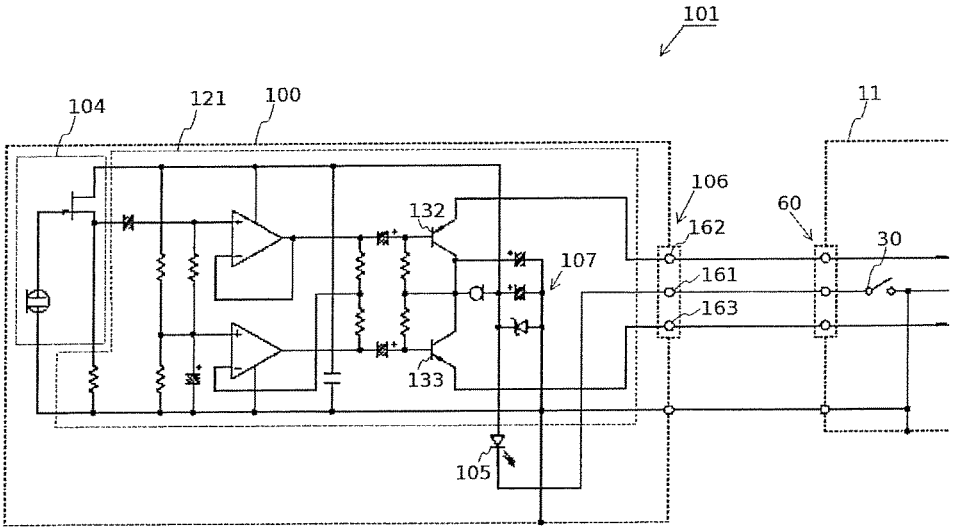
FIG.3 RELATED ART
FIG. 3 is a circuit configuration diagram illustrating a microphone circuit of a related art.
Figure 4:
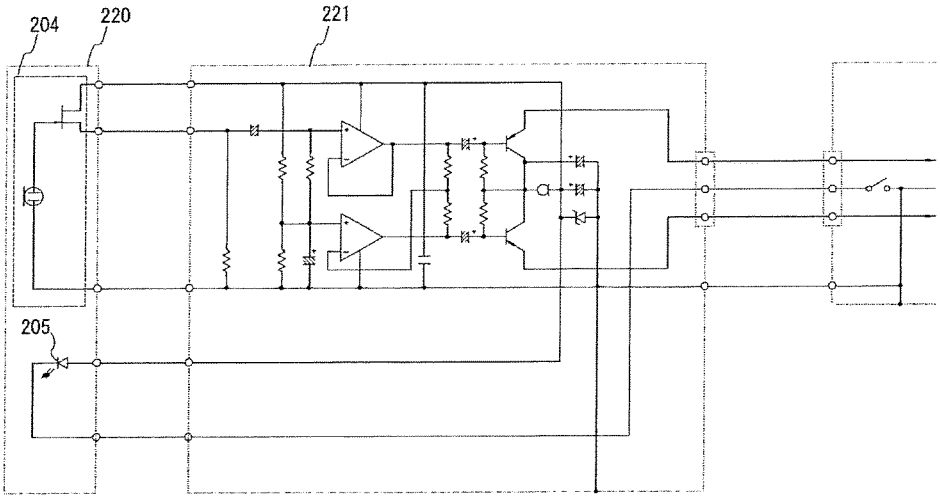
FIG.4 RELATED ART
FIG. 4 is a circuit configuration diagram illustrating a microphone circuit of a related art.

The switch 30 included in the microphone amplifier unit 11 is described in a simplified manner and is not limited to one switch element. That is, any configuration can be employed as long as a plurality of elements is switched according to a predetermined condition, and opening and short circuit of the first pin 61 and the frame ground can be switched. For example, the switch 30 may be realized by a circuit including two transistors, as described in FIG. 3 of JP 2016-163054 A.

Here, the microphone amplifier unit 11 includes detecting means for detecting whether a microphone is a microphone including an LED or a microphone not including an LED according to a potential of the first pin 61. To be specific, the microphone amplifier unit 11 detects that the microphone including an LED is connected when the first pin 61 has a positive potential. Further, the microphone amplifier unit 11 detects that the microphone not including an LED is connected when the first pin 61 has a ground potential. When detecting that the microphone including an LED is connected, the microphone amplifier unit 11 opens and closes the switch 30 to control on and off of the LED.

The microphone not including an LED is, for example, the microphone illustrated in FIG. 2 of JP 2016-163054 A. The first pin of this microphone is internally conductive with the ground. Therefore, when this microphone is connected with the microphone amplifier unit 11, the first pin 61 has the ground potential, and the microphone amplifier unit 11 detects that the microphone not including an LED is connected.

When the microphone 1 and the microphone amplifier unit 11 are connected, a constant voltage is applied to the first pin 61 of the microphone 1 from the constant voltage circuit 7. Therefore, the microphone amplifier unit 11 detects that the microphone including an LED is connected. Conversely speaking, the microphone 1 can be detected as the microphone including an LED by the existing microphone amplifier unit 11.

•Control of LED 5•

Since the conduction and opening of the first pin 61 and the frame ground terminal 69 can be switched, the control signal of the LED 5 of the microphone 1 can be transmitted from the microphone amplifier unit 11 to the LED circuit 22, using the existing three-pin connector.

When the first pin 61 and the frame ground terminal 69 are open, a constant voltage is applied from the constant voltage circuit 7 to the gate terminal of the MOS-FET 34. In other words, when a voltage is applied to the gate terminal of the MOS-FET 34, the MOS-FET 34 is turned on, and the drain and the source of the MOS-FET 34 can be regarded to be short-circuited. Therefore, the current from the constant current element 72 does not flow to the LED 5, and thus the LED 5 is turned off.

When the first pin 61 and the frame ground terminal 69 are short-circuited, the gate terminal of the MOS-FET 34 is grounded. Therefore, the MOS-FET 34 is substantially turned off. Then, the current from the constant current element 72 flows into the LED 5, and thus the LED 5 is turned on.

In this manner, on and off of the LED 5 can be controlled by the microphone amplifier unit 11 side.

Note that, in the present embodiment, the MOS-FET has been used for the LED circuit 22. However, the LED circuit 22 may be configured using an element that switches conduction and non-conduction according to a voltage of a specific terminal. For example, a switching element such as a J-FET can be used.

By connecting the anode of the LED 5 with the LED circuit 22 including the constant current element 72 and the MOS-FET 34, the cathode of the LED 5 can be connected to the ground line and the LED 5 can be lighted. Since the ground line connected to the cathode of the LED 5 can be shared with the ground line of the microphone unit 4, it is unnecessary to newly wire a ground line for the LED 5. Therefore, only one wire can be arranged in the arm 9 for the LED 5.

According to the present embodiment, in the gooseneck microphone provided with the light emitter on the head case side, the number of wires in the arm can be reduced.

Note that the gooseneck microphone has been described in the present embodiment. However, the present invention can also be applied to a headset provided with an arm.

What is claimed is:

1. A microphone, comprising:

a head case; and an arm that supports the head case, wherein the head case includes a microphone unit and a light emitter, a proximal end portion of the arm includes a light emitter circuit that turns on the light emitter on a basis of potential information of a specific terminal, one end of the light emitter is connected to the light emitter circuit through a wire that passes through an inside of the arm, a second end of the light emitter is connected to the microphone unit in the head case, the light emitter circuit includes a switching element that switches on and off the light emitter, and the specific terminal is connected to a control signal input side of the switching element.

2. The microphone according to claim 1, wherein the specific terminal is switchable to a first state connected to a ground and to a second state released from the ground, and the light emitter circuit turns on the light emitter when the specific terminal is in the first state, and turns off the light emitter when the specific terminal is in the second state.

3. The microphone according to claim 2, wherein the proximal end portion is connectable to a microphone amplifier unit including the specific terminal.

4. The microphone according to claim 1, wherein the microphone unit and the light emitter share a ground line of the arm.

5. The microphone according to claim 1, wherein the switching element is an FET, and the specific terminal is connected to a gate terminal of the FET.

6. The microphone according to claim 1, wherein the light emitter circuit includes a constant current element, and supplies a current to the light emitter through the constant current element.

7. The microphone according to claim 1, wherein the arm is made of a flexible pipe, and the flexible pipe itself serves as a ground line.

8. The microphone according to claim 1, wherein the proximal end portion includes a microphone circuit that balanced outputs an output signal of the microphone unit.

9. The microphone according to claim 1, wherein the proximal end portion includes a connector connectable to an external control device, the connector includes a hot-side signal terminal and a cold-side signal terminal, an audio signal from the microphone unit is balanced output from the connector, and a phantom power supply is supplied from the hot-side signal terminal and the cold-side signal terminal.

* * * * *